US005468418A

United States Patent [19]

Rabone

[11] Patent Number: 5,468,418

[45] Date of Patent: Nov. 21, 1995

[54] DETERGENT COMPOSITION CONTAINING MIXTURE OF HYDRATABLE AND NON-HYDRATABLE SALTS

[75] Inventor: Kenneth L. Rabone, Merseyside, England

[73] Assignee: Lever Brothers Company, Division of Conopco, Inc., New York, N.Y.

[21] Appl. No.: 346,989

[22] Filed: Nov. 30, 1994

Related U.S. Application Data

[63] Continuation of Ser. No. 920,493, Aug. 20, 1992, abandoned.

[30] Foreign Application Priority Data

Feb. 26, 1990 [GB] United Kingdom ..... 9004289

[51] Int. Cl.[6] ..... C11D 3/60; C11D 3/04; C11D 3/14; C11D 17/00

[52] U.S. Cl. ..... 252/174.25; 252/95; 252/99; 252/135; 252/139; 252/162; 252/163; 252/164; 252/174; 252/174.14; 252/177.19; 252/174.21; 252/DIG. 14

[58] Field of Search ..... 252/174.25, 95, 252/99, 135, 139, 162, 174, 174.14, 174.19, 174.21, DIG. 14, 163, 164

[56] References Cited

U.S. PATENT DOCUMENTS

| | | | |
|---|---|---|---|
| 4,051,056 | 9/1977 | Hartman | 252/160 |
| 4,316,812 | 2/1982 | Hancock et al. | 252/99 |
| 4,615,820 | 10/1986 | Hepworth et al. | 252/139 |
| 4,772,412 | 9/1988 | Green et al. | 252/96 |
| 4,889,652 | 12/1989 | Sullivan et al. | 252/99 |
| 4,988,462 | 1/1991 | Schepers et al. | 252/174.21 |
| 5,094,771 | 3/1992 | Ahmed et al. | 252/140 |
| 5,102,574 | 4/1992 | Russell et al. | 252/DIG 14 |

FOREIGN PATENT DOCUMENTS

| | | |
|---|---|---|
| 0225654 | 6/1987 | European Pat. Off. . |
| 1292352 | 10/1972 | United Kingdom . |

OTHER PUBLICATIONS

*International Search Report,* for PCT/GB91/00294, Aug. 8, 1991.

*Primary Examiner*—Paul Lieberman
*Assistant Examiner*—Ardith Hertzog
*Attorney, Agent, or Firm*—A. Kate Huffman

[57] ABSTRACT

The invention comprises liquid, non-aqueous compositions comprising: liquid nonionic surfactant in an amount of 25 to 75% by weight; having suspended therein 20 to 75% of solid particulate material with a surface weighted mean particle size in the range 1 to 100μ which comprises a combination of i) from 5 to 72% by weight of one or more salts which form hydrate(s) stable at 20° C. but are present in an anhydrous or incompletely hydrated state, together with ii) from 3 to 70% by weight of one or more salts which has no stable hydrate at 2°0 C. The combination of hydratable and non-hydratable salts enhances suspending properties while inhibiting excess gelling.

9 Claims, No Drawings

DETERGENT COMPOSITION CONTAINING MIXTURE OF HYDRATABLE AND NON-HYDRATABLE SALTS

This is a continuation application of Ser. No. 07/920,493, filed Aug. 20, 1992, now abandoned.

This invention relates to liquid compositions containing solid particles suspended in a liquid phase which is essentially non-aqueous and, at least predominantly, is nonionic surfactant.

The solid which is suspended may function as an abrasive and/or may be included for some other purpose such as to provide bleaching or detergency building when the composition is mixed with water. Compositions of the present invention include at least one hydratable salt in the suspended solid material.

Non-aqueous compositions containing suspended particulate solids are known, e.g. from GB 1292352 (Unilever). This discloses liquid detergent compositions containing nonionic surfactant as the liquid phase, with particulate water-soluble salts suspended in it. Most of these compositions also contain some organic solvent other than surfactant, usually mostly ethanol, as diluent and thinning agent.

It is desirable that a composition should provide stable suspension of the solid without however setting or gelling to an excessively viscous state.

It is especially desirable to avoid setting to a state which is excessively viscous and does not readily thin when shaken or otherwise subjected to shear.

We have found that the presence of hydratable salt in a composition contributes to the suspending properties of the composition, but excessive gelation may occur. We have now found that non-hydratable salts can be used as a solid diluent for hydratable salts and this can ameliorate excessive gelling while still achieving suspending properties.

Our GB 1292352 teaches that a small percentage of a highly voluminous inorganic carrier material of submicron size - fumed silica is suitable - may be included in a non-aqueous liquid detergent composition. Such material considerably improves the suspending properties and may be used in compositions of this invention. However, the amount of such material must be restricted. Too much of it leads to excessive gelation of the composition.

We have found that the use of a combination of hydratable and non-hydratable salts as the suspended solid can allow adequate suspension to be achieved with less of such submicron carrier than would be required in the absence of hydratable salt(s) from the suspended solid. This can ameliorate the tendency to gel into an undesirably set state.

This invention provides a liquid, non-aqueous composition comprising:

a liquid phase which is at least predominantly nonionic surfactant in an amount of 25 to 75% of nonionic surfactant by weight, having suspended therein 20 to 75% by weight of solid particulate material with a surface weighted mean particle size in the range of 1 to 100μ, better not over 70μ, which material comprises i) from 5 to 72% by weight of one or more salts which form hydrate(s) stable at 20° C. but which are present in an anhydrous or incompletely hydrated state, together with ii) from 3 to 70% by weight of one or more salts which has no stable hydrate at 20° C.;

all of the above percentages being by weight based on the whole composition.

The composition may also contain a smaller quantity, up to 5% by weight of the composition, of a suspended solid carrier material having a surface weighted mean particle size below 1μ so that it is conveniently referred to as a "submicron carrier". This material will generally be an oxide.

Compositions in accordance with the invention may serve as various types of cleaning composition. One possibility is a liquid detergent composition for use in washing fabrics. In particular, though, compositions of this invention may serve as abrasive cleaners, for instance as hard surface cleaners. Such a formulation provides a convenient method of delivering surfactant and desired solids to a surface which is to be cleaned. Certain forms of the invention are additionally advantageous in that non-aqueous liquid phase permits use of water-soluble solid abrasive particles which can be readily rinsed from the surface after cleaning.

A further advantage is that the solids present can include a peroxygen bleach which will be in a stable condition by reason of the non-aqueous environment. Admixture of water at the time of use will then make the bleach active.

As mentioned above, we have found that suspended hydratable salt increases the suspending properties of the composition and this effect adds to the suspending properties brought about by submicron carrier material, if any. By contrast, we have found that non-hydratable salts do not enhance suspending properties - at least not as much as do hydratable salts - but also do not increase the tendency to gelation and setting. Non-hydratable salts are thus able to function as a solid diluent for hydratable salts.

A preferred additional constituent of compositions of the present invention is 0.1 to 20% by weight of an organic solvent. The presence of such solvent is useful in improving the ability of the compositions to remove a range of soil from a surface. It may be preferred to avoid hydroxylic solvents, or at any rate the lower ($C_1$ to $C_6$ alcohols). These may be oxidised at varying speeds by a bleach system, if such a system is present.

Organic solvent does tend to cause a reduction in suspending properties which must then be compensated by an enhancement of the amount of carrier or hydratable salt.

The amount of nonionic surfactant must be in the range 25 to 75% by weight of the composition. Preferably the amount of nonionic surfactant is not more than 65% better not more than 50% by weight of the composition. A particularly preferred range is 35% to 49%. It is also preferred that the amount of organic solvent, if any, is not more than 8% and that the total amount of liquid phase does not exceed 55% or possibly does not exceed even 49% of the composition (all percentages being by weight based on the whole composition).

This invention may be utilised in conjunction with other expedients for ameliorating gelation while achieving good suspension of solids. Notable are the incorporation of polyvinylpyrrolidone or a derivative thereof as taught in our European application EP 359491. Another possible expedient is the incorporation of an organic acid, such as alkyl benzene sulphonic acid.

Particle Size Measurements

Various techniques for measuring particle sizes are known, but do not give results in precise agreement because particles are not always spherical and do not always have a Gaussian distribution of particle sizes. We have found it convenient to measure particle sizes and size distributions by light scattering measurements using a Malvern Mastersizer (Trade Mark). This provides a determination of surface weighted mean particle diameter and we find this is an appropriate value of particle size to use when studying sedimentation.

A description of surface weighted mean particle size (also known as volume-surface weighted) is found in chapter 4 of "Small Particle Statistics" by G Herdan, Butterworths 1960.

For preferred forms of this invention the submicron carrier will have a mean particle size which is well below 1 micron regardless of the mean size definition which is used, and the other suspended solid will have a mean particle size of at least 1 micron with most definitions of mean size.

Ingredients

The various essential and preferred ingredients of the present invention will now be discussed in greater detail.

Nonionic Surfactants

A considerable number of nonionic surfactants exist and could be used for this invention. It is preferred that the surfactant is a compound or mixture of compounds produced by the condensation of alkylene oxide groups, which are hydrophilic in nature, with an organic hydrophobic compound which may be aliphatic notably with a $C_8$ to $C_{20}$ alkyl chain or alkyl aromatic, notably with a $C_6$ to $C_{14}$ alkyl chain. The length of the hydrophilic or polyoxyalkylene radical which is condensed with any particular hydrophobic group can be adjusted to yield a water-soluble compound having the desired degree of balance between hydrophilic and hydrophobic elements. Particuiar examples of nonionic surfactants include the condensation product of aliphatic alcohols having from 8 to 22 carbon atoms in either straight or branched chain configuration with ethylene oxide, such as a coconut oil ethylene oxide condensate having from 2 to 15 moles of ethylene oxide per mole of coconut alcohol, and condensates of synthetic primary or secondary alcohols having 8 to 15 carbon atoms with 3 to 12 moles of ethylene oxide per mole of the synthetic alcohol, and condensates of alkylphenols whose alkyl group contains from 6 to 12 carbon atoms with 5 to 25 moles of ethylene oxide per mole of alkylphenol. Further examples of nonionic surfactants are condensates of the reaction product of ethylenediamine and propylene oxide with ethylene oxide, the condensates containing from 40 to 80% of polyoxyethylene radicals by weight and having a molecular weight of from 5,000 to 11,000: block copolymers of ethylene oxide and propylene oxide; tertiary amine oxides of structure $R_3NO$, where one group R is an alkyl group of 8 to 18 carbon atoms and the others are each methyl, ethyl or hydroxyethyl groups, for instance dimethyldodecylamine oxide: glycosides or polyglycosides etherified with at least one $C_8$-$C_{22}$ alkyl group or esterified with at least one $C_8$-$C_{22}$ fatty acyl group; fatty acid alkyloiamides; and alkylene oxide condensates of fatty acid alkylolamides. Mixtures of nonionic surfactant actives can be employed.

A particularly preferred category of nonionic surfactants is ethoxylated alcohols. These may in particular be derived from alcohols containing from 5 to 15 carbon atoms and ethoxylated with an average of 5 to 10 ethylene oxide residues. Especially preferred is nonionic surfactant derived from a mixture of alcohols mostly containing 9 to 11 carbon atoms and having an average of 6 ethylene oxide residues.

We prefer that such a nonionic surfactant is "topped" or "peaked", that is to say partially fractionated in order to free it from unethoxylated alcohol which tends to have an unpleasant odour.

Submicron Carrier

This material is a finely divided solid having a mean primary particle size of less than one micron, for instance in the range 1 to 900 mμ and preferably well below 900 mμ. Typically such solids will have an average surface area of 50 to 500m$^2$/g and a bulk density of 10 to 18 g/litre.

Suitable inorganic carrier materials are light highly voluminous metal and metalloid oxides including, for example, silica, alumina, magnesia and ferric oxide and mixtures thereof. These materials, particularly silicas, may readily be obtained commercially. Suitable silicas are sold by Degussa under the Registered Trade Mark Aerosil and by Cabot Corporation under the Registered Trade Mark Cab-O-Sil.

Whilst any highly voluminous inorganic carrier material having the specified physical characteristics be employed, it is preferred that the carrier material should have a bulk density within the range of from 20 to 150g/l, more particularly from 30 to 100g/l, and an average surface area lying within the range of from 150 to 400m$^2$/g. The average surface area is indicative of particle size and is defined as that measured by the Brenauer, Emmet and Teller method. The preferred particle size and size distribution of the inorganic carrier material is such that substantially all of the particles of the carrier material Lie within a size range of 1 to 100 mμ.

The amount of the submicron carrier material which is used is preferably of the order of from 0.7 to 3% by weight of the composition.

Other Suspended Solid

This comprises the mixture of hydratable and non-hydratable salts. These have an average particle size in the range of 1μ to 100μ. Desirably though they should have an average particle size smaller than 70μ to avoid palpable grittiness. It is preferred that at least 99% by weight of the particles should pass a 53μ sieve, with the average particle size being less than 50μ.

If the composition is intended to be abrasive, it is preferred that at least the water-soluble salts should have a relatively larger particle size than is preferred for a composition intended for some other application such as adding to water to make a fabric washing liquor.

Larger particle size is more appropriate for abrasive properties but brings with it the problem that larger particles sediment at a faster rate and are more difficult to maintain in a stable suspended state.

If a composition is not intended to be abrasive it will be desirable, as with known fabric washing liquids, to comminute the suspended particles to an average particle size not exceeding 10μ better not exceeding 5μ.

If a composition is intended to be abrasive it is preferred that the water-soluble salts should have an average particle size exceeding 5μ. The hydratable and the non-hydratable salts may both satisfy this requirement.

More preferably the surface weighted mean particle size of the water-soluble salt(s) present is between 10 and 25μ while the particle size distribution satisfies the relationship:

$$1.5 < \frac{D(v,0.9) - D(v,0.1)}{D(v,0.5)} < 3.0$$

where D(v,0.5) is the median particle diameter, D(v,0.9) is the upper decile diameter (i.e. 10% of particles are larger, 90% are smaller) and D(v,0.1) is the lower decile diameter.

An exception to this preference for particle sizes larger than 5μ arises with the insoluble material calcite. This is somewhat harder than water-soluble salts generally are, and therefore is abrasive when used at smaller particle sizes such as 2 to 5μ.

The suspended solid can function as an abrasive. As explained below, it may serve other functions. The size range mentioned above is smaller than is customary in liquid abrasive cleaners. It is advantageous in giving less tendency to scratch and easier rinsing.

The suspended solid should preferably constitute between 20 or 25% and 60% by weight of the composition. More preferably it constitutes between 35 and 58% by weight of the composition. In particularly preferred compositions the total amount of suspended solid other than the submicron carrier is at least 51% by weight of the composition.

Hydratable Salts

These are almost inevitably water-soluble. They are used in a state which is incompletely hydrated. Ideally they are anhydrous but a limited water content can be tolerated.

A wide range of salts have hydrates at 20° C. and can be used. Organic salts such as citrates may possibly be used, but inorganic salts will generally be used.

Examples of inorganic salts which have hydrates are sodium carbonate, sodium tripolyphosphate, sodium sulphate, sodium silicate in various forms, and the double salt sodium sesquicarbonate. Sodium citrate and the organic builder sodium nitrilotriacetate are both hydratable. It will be appreciated that a number of these salts are known detergency builders and can function as such when the composition is eventually diluted with water during use.

The hydratable salt can be a peroxygen bleach. Sodium perborate and sodium percarbonate are both hydratable salts. Sodium percarbonate is a perhydrate of sodium carbonate and is further hydratable, analogously to sodium carbonate itself.

The amount of hydratable salt is desirably sufficient, in relation to the amount of voluminous submicron inorganic carrier, to reduce sedimentation to a very low level. Sedimentation can be observed as the volume of clear liquid which separates at the top of a column of the composition in a measuring cylinder. Preferred compositions have not more than 1% separation after standing for 10 days.

The amount of hydratable salt should not cause gelling of the composition, or at any rate should allow a reasonable storage time before serious gelling. The effect of hydratable salts varies from one to another. Thus sodium perborate and sodium carbonate both cause a greater enhancement of suspending properties than an equal amount of sodium tripolyphosphate, but the amount of them which can be tolerated without gelling is also less.

It is preferred that the amount of hydratable salt is 5 to 45% by weight of the composition. In an abrasive composition the amount will generally be 5 to 25% by weight of the composition and preferably is 8 to 20% by weight of the composition.

Non-hydratable Salts

A number of water-insoluble non-hydratable salts exist and can be used. Calcite is a preferred example. Others are feldspar and dolomite.

Alternatively a water-soluble but non-hydratable salt can be used. This is advantageous in that the entire composition can be water-soluble, and hence can be rinsed away with water without leaving any insoluble residue. Such complete solution on rinsing helps to avoid leaving any undesired residue on cleaned surfaces. Salts which are water-soluble but non-hydratable appear To be uncommon. The salt envisaged for this use is sodium bicarbonate (whose water-solubility is rather low).

The amount of non-hydratable salt is a balancing quantity as required to increase the total amount of suspended solid to the desired level but in accordance with this invention it is at least 10% of the composition. More preferably it is at least 10% of the composition. It may lie in the range 10 to 55% of the composition, with amounts at the higher end of this range being appropriate for abrasive compositions where the non-hydratable salt can serve as abrasive material. Thus the amount may be 30 to 50% of the composition.

Solvent

Some form of organic solvent is desirably included, but this does tend to cause a reduction in suspending properties which must then be compensated by an enhancement of the amount of carrier or hydratable salt.

Bleach Activator

When the hydratable salts include a peroxygen bleach, a bleach activator may be included in the composition. The preferred material is tetraacetylethylenediamine (TAED). It is a fairly soft organic solid and may dissolve, at least partially, in organic solvent (if present) and nonionic surfactant. Its density is about 1g/ml and so is similar to that of the surfactant and it appears to have little or no effect on the properties of the composition.

Water Content

The composition should not contain sufficient moisture to destroy its non-aqueous character. Depending on the nature of the suspended solids some moisture content may be acceptable.

Generally it is desirable that the quantity of moisture in the composition, excluding any water bound as water of hydration of suspended solids, should not exceed 5% of the composition by weight. If a bleach is present this free moisture content should preferably not exceed 1%, better 0.1% of the composition by weight.

EXAMPLES

A number of compositions were prepared using a standard preparative procedure.

In these Examples the nonionic surfactant was $C_9$-$C_{11}$ alcohol ethoxylated with average 6EO and topped to remove residual unethoxylated alcohol. Organic solvent was a paraffinic/alcohol solvent mixture. The carbon chains in both solvents contain more than six carbon atoms. Inorganic carrier was Aerosil 380, a fumed silica available from Degussa AG and which has a primary particle size cf less than 50 mμ (the manufacturers quote 7 to 40 mμ).

Sodium carbonate and tripolyphosphate were used in forms which are almost anhydrous. Sodium perborate was used as the so-called monohydrate which is actually an anhydrous dimer of sodium borate and hydrogen peroxide.

As a preliminary step the various-solid constituents, except for the fumed silica, were comminuted using a fine impact mill equipped with stud discs (Alpine Process Technology Ltd, Model 160UPZ), so as to pass a 53 micron sieve. Particle sizes of the solids, as used in all Examples, were as quoted in Example 1.

Preparation of the compositions was then carried out in three stages. First the liquid base was prepared by stirring together in a beaker the requisite amounts of nonionic surfactant, organic solvent and perfume using a Heidolph RZR50 paddle stirrer and then adding the fumed silica (Aerosil 380). To complete the preparation of the liquid base, after the addition of the silica, stirring was continued for 10 minutes using a Silverson laboratory mixer equipped with a special shaft with a hard coating on the journal area, a medium emulsor screen and axial flow head. Finally, the requisite quantities of the other solids were stirred into the liquid base, using the paddle stirrer once again.

Samples of each composition were poured into graduated cylinders and stored. By inspection of the cylinders at intervals it was possible to observe the volume of liquid above the volume still containing suspended solid. This volume of separated liquid was expressed as a percentage of the total volume of liquid. If it was seen that a composition had obviously gelled to a set state, this was noted.

In some instances the extent of gelation (setting) of a composition was assessed in either or both of two ways. One assessment procedure consisted of decanting off the clear supernatant, if any, and then rating the firmness of the residual sediment as a setting index on a scale from 1 to 6. The lowest number, 1, denotes a sediment which is pourable without preliminary agitation. The numbers 2 to 6 were assigned according to the number of strokes of a glass tube needed to liquify the sediment to the point of being just pourable. A setting index of 6 denotes a firmly set composition.

The other assessment for gelation consisted of resting the same glass tube, end-on, on the residual sediment and observing whether in a short time it penetrated fully (F) through the sediment to the bottom of the graduated cylinder, partially (P) or not at all (N).

Example 1

Trial compositions were prepared by the above procedure, omitting the step of adding silica. The ingredients of each composition are tabulated below. Also set out below is the separation after varying periods of time.

| Formulations (% by weight) | A | B | C | D |
|---|---|---|---|---|
| Nonionic surfactant | 46 | 46 | 46 | 46 |
| Sodium tripolyphosphate | 54 | | | |
| Sodium bicarbonate | | 54 | | |
| Sodium perborate | | | 54 | |
| Calcite | | | | 54 |

| Separation Data (%) | | | | |
|---|---|---|---|---|
| No. of days | A | B | C | D |
| 0 | 0 | 0 | 0 | 0 |
| 1 | gelled | 7.5 | 0 | |
| 2 | gelled | 13.5 | 0 | 1.5 |
| 4 | gelled | 17.0 | 0 | |
| 5 | gelled | | | 3.5 |
| 7 | gelled | 18.0 | 1.0 | 6.5 |
| 9 | gelled | 18.5 | 1.0 | 9.0 |
| 11 | gelled | 18.5 | 1.0 | |
| 14 | gelled | 18.5 | 1.5 | |
| 16 | gelled | 18.5 | 1.5 | |

The densities and particle sizes of the suspended solids were not identical. The densities, mean particle diameters, and theoretical initial sedimentation rates (rates at the start of sedimentation, calculated using Stokes equation modified by Steiner) were:

| | Density (g/cc) | Surface-weighted mean diameter (microns) | Calc. initial sedimentation rate (mm/day) |
|---|---|---|---|
| Sodium tripolyphosphate | 2.54 | 19.4 | 18.3 |
| Sodium bicarbonate | 2.15 | 20.4 | 27.0 |
| Sodium perborate monohydrate | 2.15 | 12.1 | 7.1 |
| Calcite (Durcal 2) | 2.7 | 4.0 | 1.2 |

By contrast, the actual results set out above show a radical difference between the behaviour of the two types of salts. The hydratable salts (tripolyphosphate and perborate monohydrate) barely sediment, if at all, because of gelling whereas the non-hydratable bicarbonate and calcite do sediment.

Example 2

Trial compositions were prepared by the procedure mentioned above. Some contained 46% liquid, others 60% liquid. The formulations and the extent of separation after varying periods of time are set out in the following Tables. If it was noted that a composition had obviously gelled To a set state, this was noted with the abbreviation "gld".

Assessments of gelation by the procedures described above are also quoted in these Tables.

| Formulations (% by weight) | | | | | | | | | | | | | | | | | |
|---|---|---|---|---|---|---|---|---|---|---|---|---|---|---|---|---|---|
| Nonionic surfactant | 41 | 41 | 41 | 41 | 41 | 41 | 41 | 41 | 41 | 53.48 | 53.48 | 53.48 | 53.48 | 53.48 | 53.48 | 53.48 | 53.48 |
| Organic solvent | 5 | 5 | 5 | 5 | 5 | 5 | 5 | 5 | 5 | 6.52 | 6.52 | 6.52 | 6.52 | 6.52 | 6.52 | 6.52 | 6.52 |
| Fumed silica | 0 | 2.5 | 2.6 | 2.75 | 3.25 | 0 | 0 | 0 | 2.5 | 0 | 2.5 | 3.25 | 3.3 | 3.5 | 0 | 0 | 0 |
| Sodium bicarbonate | 54 | 51.5 | 51.4 | 51.25 | 50.75 | 0 | 0 | 0 | 0 | 40 | 37.5 | 36.75 | 36.7 | 36.5 | 0 | 0 | 0 |
| Sodium perborate | 0 | 0 | 0 | 0 | 0 | 54 | 0 | 0 | 0 | 0 | 0 | 0 | 0 | 0 | 40 | 0 | 0 |
| Sodium tripolyphosphate | 0 | 0 | 0 | 0 | 0 | 0 | 54 | 0 | 0 | 0 | 0 | 0 | 0 | 0 | 0 | 40 | 0 |
| Calcite | 0 | 0 | 0 | 0 | 0 | 0 | 0 | 54 | 51.5 | 0 | 0 | 0 | 0 | 0 | 0 | 0 | 40 |

| Separation Data (%) | | | | | | | | | | | | | | | | | |
|---|---|---|---|---|---|---|---|---|---|---|---|---|---|---|---|---|---|
| No. of Days | | | | | | | | | | | | | | | | | |
| 5 | 9.5 | 3.5 | 0 | gld | gld | 0 | gld | 10.5 | 0 | 33 | 0.5 | 0 | 0 | 0 | 0 | 8 | 26 |
| 10 | 9.5 | 5 | 0 | gld | gld | 0 | gld | 14 | 0.5 | 33 | 1 | 0.5 | | 0 | 0 | 8 | 34.5 |
| 15 | 9.5 | 5.75 | | gld | gld | 0.5 | gld | | 0.5 | 33 | 1 | 0.5 | 0.25 | | 0.5 | 8 | |
| 20 | 9.5 | | 0.25 | gld | gld | 0.5 | gld | 16 | 0.5 | 33 | 1 | 0.5 | | 0.5 | | 8 | 43 |
| 30 | 9.5 | 6 | | gld | gld | 0.5 | gld | | | 33 | 1 | 0.5 | 0.5 | 0.5 | gld | | |
| 40 | 9.5 | 6 | 0.5 | gld | gld | gld | gld | 17.5 | 1.5 | 33 | 2.25 | 0.5 | | 0.5 | gld | 7 | |
| 120 | 8 | 5 | 1 | gld | gld | gld | gld | 19 | 3.5 | 31.5 | 5 | 2 | 1.5 | 1 | gld | 7 | 50 |
| Setting Index | 1 | 3 | 6 | 4 | 5 | 4 | 6 | 2 | 4 | 1 | 2 | 3 | 3 | 5 | 5 | 1 | 1 |
| Penetration | P | P | P | P | N | N | N | F | P | F | F | P | P | P | N | F | F |

It can be seen from these results that at a level of 40% solids it was not possible to use sodium perborate monohydrate as the only suspended solid. At 54% solids neither perborate nor tripolyphosphate could be incorporated as sole suspended solid. If silica was used in sufficient quantity to keep a suspension of bicarbonate stable, then the compositions were found to gel to an unsatisfactory set state.

By contrast, a composition of the following formulation was prepared and tested.

| | % by weight |
|---|---|
| Nonionic surfactant | 37.0 |
| Organic solvent | 5.0 |
| Aerosil 380 | 2.5 |
| Sodium bicarbonate | 42.5 |
| Sodium perborate | 10.0 |
| Perfume | 1.5 |
| Tetraacetylethylenediamine | 1.5 |

Separation over 40 days was less than 1%. Setting index was 2 and penetration was full. Thus there was satisfactory suspension without excessive gelation.

Example 3

Compositions were prepared with ingredients as set out in the following Table, in which separations after periods of time are also quoted.

| | A | B | C | D | D | F | G | H |
|---|---|---|---|---|---|---|---|---|
| | Formulations (% by weight) | | | | | | | |
| Nonionic surfactant | 38.75 | 38.5 | 43.5 | 38.25 | 38.0 | 38.0 | 43.25 | 38.25 |
| Organic solvent | 5 | 5 | 0 | 5 | 5 | 5 | 0 | 5 |
| Perfume | 0.5 | 0.5 | 0.5 | 0.5 | 0.5 | 0.5 | 0.5 | 0.5 |
| Fumed silica | 1.75 | 2.0 | 2.0 | 2.25 | 2.5 | 2.5 | 2.25 | 2.25 |
| Sodium bicarbonate | 39.0 | 39.0 | 39.0 | 39.0 | 39.0 | 37.5 | 49.0 | 37.5 |
| Sodium tripoly-phosphate | 3.5 | 3.5 | 3.5 | 3.5 | 3.5 | 5.0 | 5.0 | 5.0 |
| Sodium perborate | 10.0 | 10.0 | 10.0 | 10.0 | 10.0 | 10.0 | 0 | 10.0 |
| Tetraacetyl-ethylene-diamine | 1.5 | 1.5 | 1.5 | 1.5 | 1.5 | 1.5 | 0 | 1.5 |
| | Separation (% after number of days stated) | | | | | | | |
| 10 | 2.0 | 1.0 | 1.0 | 1.0 | | 0.0 | 1.0 | 0.0 |
| 20 | | | | | | 0.0 | | 0.5 |
| 30 | 3.0 | 2.5 | 2.0 | 2.0 | 1.0 | 1.0 | 2.5 | |
| 40 | | 4.5 | 2.0 | 2.0 | | 1.0 | | 1.0 |
| 60 | 4.5 | 5.0 | 2.0 | 2.0 | 3.0 | 1.0 | | |
| 80 | | | 2.5 | | | | | 2.5 |
| 100 | 6.0 | 6.5 | | 2.5 | | | | |
| 120 | | | 3.5 | | | | | |

Compositions A, B, D and E show that increasing silica enhances suspending properties.

Compositions C and D show that solvent slightly reduces suspending properties.

Compositions E and F or D and H show that sodium tripolyphosphate enhances suspending properties.

Comparison of composition H with composition G shows that perborate enhances suspending properties (but this is partly offset by the presence of solvent in composition H).

Example 4

A composition was prepared using a fine calcite as the non-hydratable salt. This abrasive is the same as the calcite referred to in Example 1; it was Durcal 2 available from Omya. A similar composition was prepared using sodium carbonate and bicarbonate. The two formulations were as follows:

| Ingredient | | A | B |
|---|---|---|---|
| | | % by weight | |
| Nonionic surfactant | | 38.5 | 38.8 |
| Organic solvent | | 5.0 | 5.0 |
| Perfume | | 0.5 | 0.5 |
| Fumed silica | | 2.0 | 2.2 |
| Abrasive | Calcite (Durcal 2) | 39.0 | — |
| Abrasive | Sodium carbonate | — | 21.0 |
| Abrasive | Sodium bicarbonate | — | 21.0 |
| Builder | Sodium tripolyphosphate | 3.5 | — |
| Bleach | Sodium perborate | 10.0 | 10.0 |
| | TAED | 1.5 | 1.5 |
| | | 100.0 | 100.0 |

On storage both of these compositions were found to display only slight separation and thickening.

Both formulations A and B were tested for physical cleaning efficiency in comparison with a current commercial product having an aqueous liquid phase. The efficiency was tested on the following soiled substrates.

1. Microcrystalline Wax on Perspex

Clear perspex sheet (ex ICI) was evenly sprayed with petroleum spirit (fraction boiling between 100 and 120° C.) saturated with microcrystalline wax (Mobil No 2360,) coloured with oil-soluble dye Fast Red 7B (CI 26050) After spraying, the sheet was placed in an oven at 50° C. to ensure complete removal of the solvent. From the weight of the wax deposited on the sheet (ca 0.28g) and the surface area (ca 280cm$^{-2}$), the thickness of the layer was estimated as about 10 μ (assuming a value of 0.8 for the density of the wax ) .

2. Calcium Stearate on Perspex

A solution of stearic acid in chloroform was sprayed onto Perspex sheet as above (following the established code of practice for safe handling of chloroform). The plate was then repeatedly immersed in a solution of calcium chloride and left to dry in an oven at 50° C. A damp tissue was used to wipe non-adherent salts from the surface, leaving behind a thin hard layer of calcium stearate.

3. Artificial Hard Bath Tub Soil (HBTS) on Enamel

Calcium stearate (75g), carbon black (0.5 g Elftex 125) and isopropanol (250ml) were mixed together thoroughly and dispersed by application of ultrasound. The dispersion was diluted as necessary with isopropanol and sprayed in a band down the centre of a white enamelled steel plate. The plate was then placed in an oven preheated to 180° C. for 20 minutes.

4. Shoe Polish on White Vinyl

Shoe polish was applied with a tissue in a band in the middle of a white vinyl tile. The tile was aged overnight before use.

5. Shoe Rubber on White Vinyl

Rubber was cut from the sole of a discarded shoe and applied in close straight lines on a white vinyl tile to give a band of rubber-marked tile.

Soil removal was determined using a Sheen Instruments in-line scrubber equipped with a cellulose sponge and operating at a relatively low surface pressure (28g cm$^{-2}$) equivalent to light rubbing. Tests were carried out by pre-moistening a clean sponge and applying a fixed amount of formulation (1 ml). The number of strokes required to completely remove the soil from a variety of soil/substrate combinations was determined. Results are presented in the Table below as:

$$\text{Efficiency Relative to Commercial Product} = \frac{\text{No of strokes to remove with commercial product}}{\text{No of strokes to remove with test formulation}}$$

| Soil/Substrate | Formulation: Commercial Product | A | E |
|---|---|---|---|
| Microcrystalline wax/Perspex | 1.0 | 4.8 | 4.5 |
| Ca stearate/Perspex | 1.0 | — | 1.5 |
| HBTS/enamel | 1.0 | 1.1 | 1.3 |
| Shoe polish/vinyl | 1.0 | 1.9 | 2.1 |
| Shoe rubber/vinyl | 1.0 | 18.3 | 42.3 |

The non-aqueous formulations clearly perform very well on oily and waxy soils and exceptionally well on rubber-marked vinyl. Performance was similar on both artificial bath scum soils consisting mainly of calcium stearate on Perspex and enamel.

Application of an aqueous slurry of either formulation to tea-stained unglazed white ceramic tiles resulted in removal of about half the colour of the stain (as determined by reflectance measurement) within about 1 minute. Increasing the contact time to 30 minutes did not substantially increase the bleaching effect.

Example 5

The formulations A and B of the preceding Example were compared with each other and the above-mentioned commercial product in a test of surface scratching. In this test a clear polymethylmethacrylate surface was rubbed with the formulation.

A Sheen in-line scrubber was used with pre-moistened terry toweling operating over a range of surface pressures (28–149 g $cm^{-2}$). The change in reflectance at 60° C. from normal incidence was measured after 100 strokes (10 ml formulation) using a BYK Chemie 'Color Gloss' gloss meter equipped with a multi-angle gloss sensing head.

The formulations were also compared on painted wooden tiles using a Wool Industries Research Association abrasion tester with pre-moistened terry toweling covered heads operating at a surface pressure of 422 g $cm^{-2}$ (500 rubs, 20 ml formulation).

It was found that both non-aqueous formulations caused less damage than the commercial product. On polymethylmethacrylate, formulation B was superior to formulation A.

What is claimed is:

1. A liquid, non-aqueous composition comprising:

liquid nonionic surfactant in an amount of 25 to 75% by weight having suspended therein 20 to 75% of a solid particulate material with a surface weighted mean particle size in the range 1 to 100 microns which comprises i) from 10 to 20% by weight of one or more water-soluble salts which form hydrate(s) stable at 20° C. but are present in a substantially anhydrous state, selected from the group consisting of sodium tripolyphosphate, sodium carbonate, sodium percarbonate, sodium perborate, sodium sulphate, sodium silicate, sodium sesquicarbonate, sodium citrate and sodium nitrilotriacetate together with ii) from 30 to 50% by weight of one or more salts which has no stable hydrate at 20° C., selected from the group consisting of sodium bicarbonate, calcite, feldspar and dolomite, the average particle size of all water-soluble salts in said particulate material being 10 microns or greater, said composition further comprising 0.5 to 5% by weight of a suspended carrier material selected from the group consisting of silica, alumina, magnesia, ferric oxide and mixtures thereof, said carrier material having a surface weighted mean particle size in the range from 1 to 900 millimicrons, all of the above percentages being by weight based on the whole composition.

2. A composition according to claim 1 wherein the component ii salt is selected from the group consisting of sodium bicarbonate and calcite.

3. A composition according to claim 1 wherein the component ii salt is selected from the group consisting of calcite, dolomite and feldspar.

4. A composition according to claim 1 wherein the component i salt is selected from the group consisting of sodium tripolyphosphate, sodium carbonate, sodium percarbonate, sodium perborate and mixtures thereof.

5. A composition according to claim 1 wherein at least part of the component i salt is a peroxygen bleach.

6. A composition according to claim 1 wherein the mixture of component i and component ii salts has a surface weighted mean particle size in the range from 1 to 50μ and substantially all the particles have a size below 70μ.

7. A composition according to claim 1 wherein the said solid particulate material provides 51 to 60% of the composition.

8. A composition according to claim 1 wherein the nonionic surfactant is a condensation product of ethylene oxide with an organic hydrophobic compound containing at least eight carbon atoms.

9. A composition according to claim 1 further comprising 0.1 to 20% by weight of organic solvent.

* * * * *